United States Patent [19]

Brett et al.

[11] Patent Number: 4,721,172

[45] Date of Patent: Jan. 26, 1988

[54] APPARATUS FOR CONTROLLING THE FORCE APPLIED TO A DRILL BIT WHILE DRILLING

[75] Inventors: J. Ford Brett, Tulsa; Tommy M. Warren, Coweta; Warren J. Winters, Tulsa, all of Okla.

[73] Assignee: Amoco Corporation, Chicago, Ill.

[21] Appl. No.: 801,124

[22] Filed: Nov. 22, 1985

[51] Int. Cl.[4] ..... E21B 4/02

[52] U.S. Cl. ..... 175/26; 175/27; 175/107; 408/12

[58] Field of Search ..... 408/189, 10, 12, 56, 408/57, 59, 60, 61, 705; 175/26, 27, 107, 24, 25, 38; 407/11; 409/135, 136

[56] References Cited

U.S. PATENT DOCUMENTS 2,879,032 3/1959 Whottle ..... 175/26

FOREIGN PATENT DOCUMENTS 428379 7/1967 Switzerland ..... 408/57
1099673 1/1968 United Kingdom ..... 175/26
274036 1/1969 U.S.S.R. ..... 175/26
608910 5/1978 U.S.S.R. ..... 175/26

*Primary Examiner*—Z. R. Bilinsky
*Attorney, Agent, or Firm*—Scott H. Brown; Fred E. Hook

[57] ABSTRACT

A method of apparatus for controlling in a wellbore the force applied to a rotating drill bit of the type having fluid circulating through an opening in the lower end thereof. One aspect of the method comprises sensing the torque in the drill bit and varying the flow of the circulating fluid through the drill bit responsive to the torque. Apparatus is provided for maintaining constant torque in the drill bit by varying the fluid flow through the bit, which varies in turn the weight applied to the bit and therefore bit torque.

8 Claims, 11 Drawing Figures

APPARATUS FOR CONTROLLING THE FORCE APPLIED TO A DRILL BIT WHILE DRILLING

BACKGROUND OF THE INVENTION

1. Field of the Invention

The present invention relates to methods and apparatus for controlling the force applied to a drill bit while drilling and, more particularly, to such methods and apparatus which vary the flow of fluid circulating in a string of drill pipe to achieve such control.

2. Setting of the Invention

A common configuration for drilling wells includes a drill bit suspended from a string of drill pipe. Often, the drill bit includes openings in the lower end thereof to enable circulation of drilling fluid down the pipe string, through the bottom of the bit, and upwardly into the annulus between the outer surface of the pipe string and the wellbore. In conventional rotary drilling, the drill string is rotated while the fluid circulation flushes cuttings from the bottom of the wellbore and cools the drill bit.

In another form of drilling, a cylindrically-shaped downhole hydraulic motor is suspended from the lower end of a string of drill pipe and a drill bit having openings in the lower end thereof is mounted on a tubular drive shaft which extends from the lower end of the motor. Fluid is circulated down the drill string and through the motor thereby rotating the drive shaft. Fluid continues through the drive shaft, out of the bottom of the bit, and into the annulus. Thus, the fluid powers the downhole motor and, as in conventional rotary drilling, flushes cuttings from the bottom of the hole and cools the drill bit during drilling.

The destructive energy which is generated between the drill bit and the rock is related directly to the weight which is applied to the drill bit. In normal drilling operations of both the rotary and downhole-motor type, the weight applied to the bit is controlled at the surface of the well by varying the force used to suspend the drill string. For some types of bits (i.e., drag bits, diamond bits), the effective weight applied to the bit is also affected by the flow rate of circulating fluid through the bit. As the fluid flows from the drill string, through the bit, and into the wellbore beneath the bit, an upward force is generated by the pressure differential below and above the bit. This force is equal to the pressure drop times the effective pressurized area of the bit and tends to reduce the weight applied to the bit as it increases. This force is commonly referred to as the "pump-off effect."

The bit weight required to maintain a particular energy level varies with changes in rock properties, drill bit dullness, and the quality and quantity of fluid circulating through the bit. Such an energy level can be maintained by applying a substantially constant amount of torque to the drill bit which maximizes the rate of penetration while avoiding rapidly dulling or destroying the drill bit.

Several problems arise when attempting to apply a constant level of torque to the drill bit. Both the weight applied to the bit and rotary torque applied to the bit as measured at the surface are inaccurate due to wellbore friction acting on the drill string. Although there exists commercially available devices for measuring weight applied to the bit and drill bit torque at the bit, when such are used to transmit information to the surface to vary the force used to suspend the drill string, the response time is insufficient to avert drill bit failure when the property of rock through which the bit is drilling suddenly changes.

In the case of drilling with downhole motors, additional problems are encountered. When using a turbine-type downhole motor, maximum turbine output power is achieved at a selected output torque and rate of rotation. Since bit torque increases nearly linearly as the weight applied to the drill bit increases, it is desirable to operate with a weight applied to the drill bit which permits the turbine to operate at its maximum output power. Since, as noted above, it is difficult to determine the weight applied to the bit and to maintain this weight during drilling, turbines rarely operate at their peak power. When the weight applied to the bit is less than that required to obtain peak power, the drill bit is underloaded and underutilized. When the weight applied to the drill bit is greater than that which produces peak power, the drill bit is excessively worn.

A positive-displacement-type downhole motor operates at its peak power very near its stall point. Thus, variations in the weight applied to the drill bit, which vary the amount of torque necessary to turn the bit, can stall the motor.

There exists a need for a method and apparatus for controlling the advancement of, as well as the load applied to a drill bit. Moreover, there exists a need for such a method and apparatus in which the weight-on-bit is controlled to obtain a constant drill bit torque.

SUMMARY OF THE INVENTION

The present invention comprises a novel method and apparatus for controlling the force applied to a drill bit by varying the flow of fluid circulating through the bit. The apparatus of the invention includes means for sensing a parameter associated with the drill bit which is related to the torque applied thereto, e.g., in the case of a downhole turbine motor, the rate of rotation. A valve is provided for varying the flow of the circulating fluid through the drill bit responsive to the sensed parameter. Such flow variations change the weight applied to the bit and, therefore, the bit torque. During drilling, the apparatus controls the force applied to and the advancement of the bit by applying a preselected constant level of drill bit torque.

In another aspect of the invention, the circulation flow through the bit is modified in response to the torque applied to the drill bit.

The present invention is particularly useful for maintaining a constant preselected drill bit torque on a drill bit powered by a downhole hydraulic motor.

DETAILED DESCRIPTION OF THE PREFERRED EMBODIMENTS

The present invention provides a method and apparatus for controlling the force applied to a drill bit while drilling by varying the flow of fluid circulating through the bottom of the bit. One aspect of the apparatus of the invention comprises means for sensing a parameter associated with the drill bit which is related to the torque applied thereto, e.g., in the case of a turbinetype downhole hydraulic motor, the rate of turbine rotation. An automatically controlled valve is provided for varying the flow of the circulating fluid through the drill bit in response to the sensed parameter. With appropriately designed valve control, the torque applied to the drill bit remains at a preselected constant level by varying the flow rate of fluid circulating through the drill bit which in turn varies the weight applied to the bit.

Figure 1:
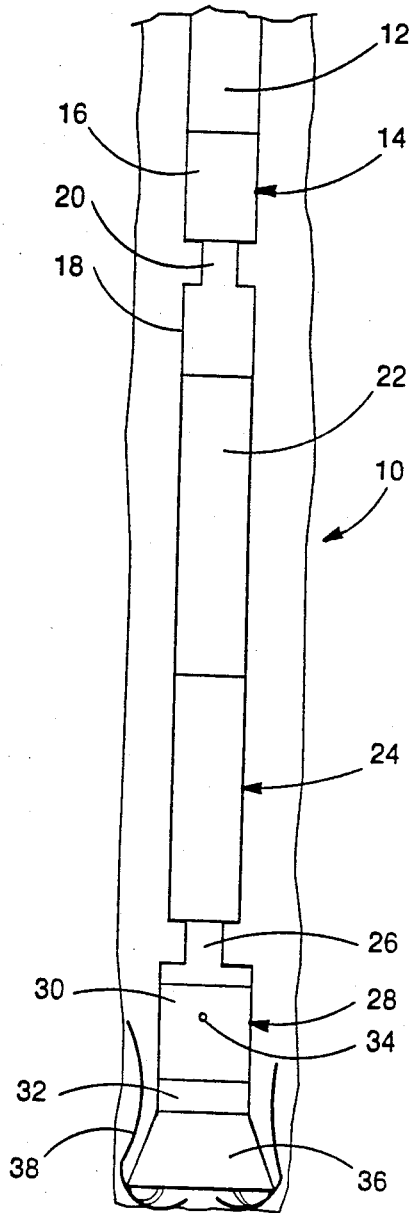
FIG. 1 is an elevational view of a preferred embodiment of the apparatus of the invention in combination with a downhole hydraulic motor in a wellbore.

Referring now to the drawings, and particularly to FIG. 1, indicated generally at 10 is a wellbore. Included therein is a string of drill pipe 12 which extends upwardly to the surface of the well (not shown) where it is suspended in the usual fashion. A coupling 14 is fixedly connected to the lower end of the string of drill pipe by means of a threaded connection (not visible). Coupling 14 includes an upper tubular portion 16 and a lower tubular portion 18. A tubular shaft 20 is fixedly mounted on the top of portion 18 and is telescopingly received within portion 16. Portion 16 and shaft 20 are interconnected in a manner which permits relative axial movement, within a predetermined limit, of portion 16 and shaft 20, but which prohibits relative radial movement. In other words, when portion 16 is rotated, shaft 20 and portion 18 also rotate. The interior portions 16, 18 and shaft 20 are all in fluid communication with one another.

A weighted pipe 22 having its upper end threadably connected to the lower end of coupling 14 provides additional weight. A downhole hydraulic motor 24 is threadably mounted on the lower end of pipe 22 and includes a hollow drive shaft or rotor 26 which extends downwardly out of the lower end thereof. Hydraulic motors, like motor 24, which are used to provide downhole rotary power to a drill bit are commercially available. One such type is a turbine motor and another such type is a positive-displacement motor, both of which are powered by fluid pumped to (and through) the motor via the drill string.

Figure 3:
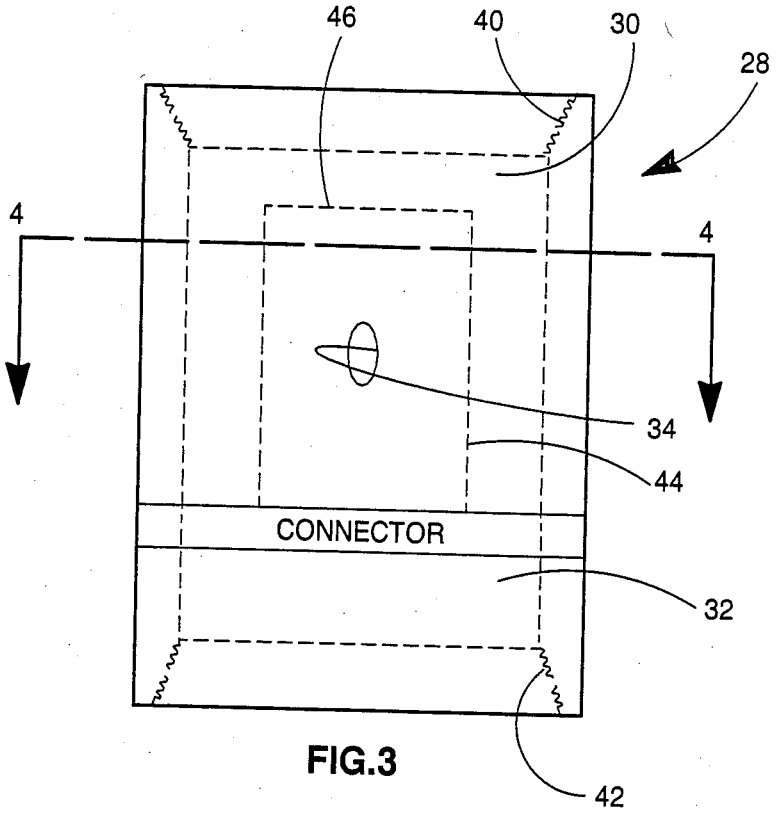
FIG. 3 is an enlarged view of a portion of both FIG. 1 and FIG. 2.
Figure 4:
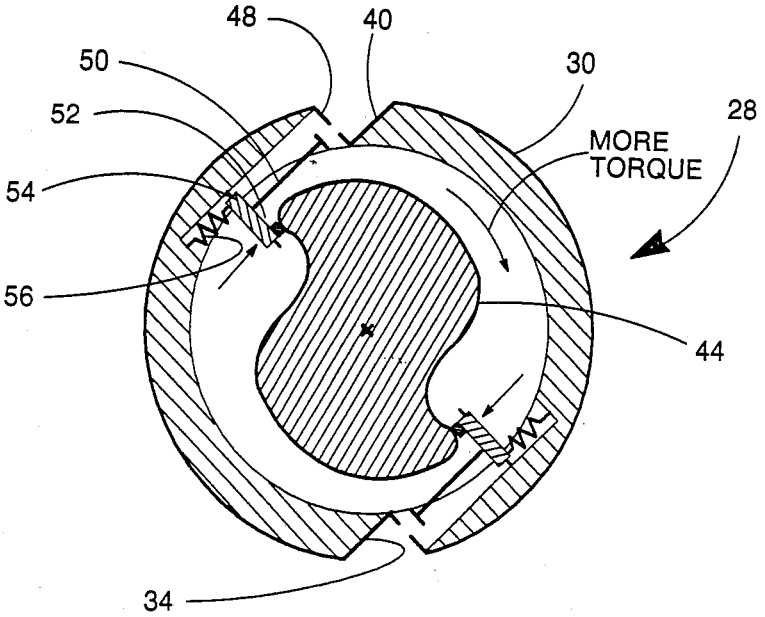
FIG. 4 is a cross-sectional view taken along lines 4—4 in FIG. 3.

A coupling 28, referred to herein as torque sensing means, which is shown in more detail in FIGS. 3 and 4, includes an upper assembly 30, which is fixedly connected via a threaded connection (not visible) to rotor 26, and a lower assembly 32. A port 34 is provided in upper assembly 30. Additional structure included in coupling 28 and the operation thereof will be described in more detail hereinafter.

A commercially available drill bit 36 is firmly threadably engaged to the lower portion of coupling 28. Drill bit 36 includes openings in the lower end thereof (not visible) through which circulating fluid 38 flows. Fluid 38 is pumped via drill string 12, coupling 14, pipe 22, motor 24, and coupling 28 into drill bit 36 and from there through the openings into the wellbore.

Figure 2:
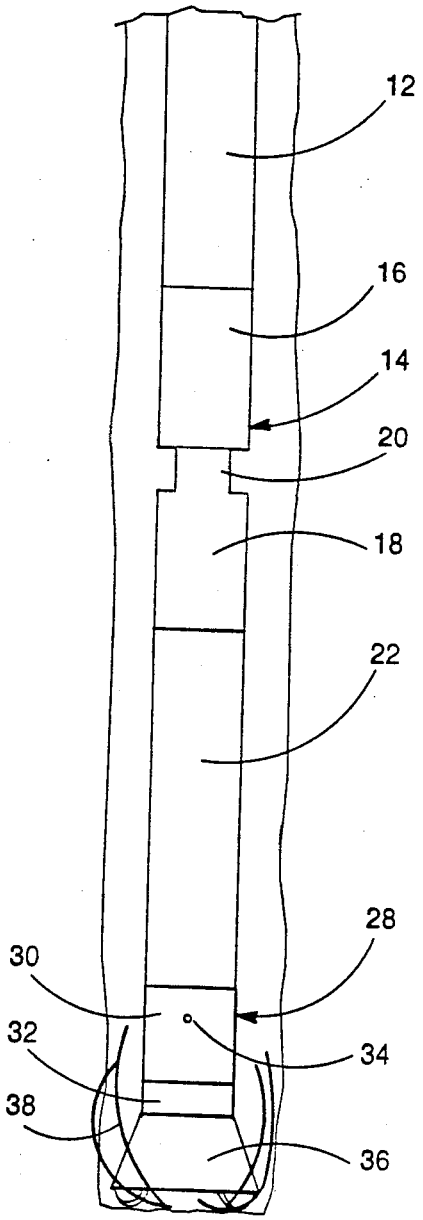
FIG. 2 is a side elevational view of a preferred embodiment of the apparatus of the invention in a wellbore during conventional rotary drilling.

Turning to FIG. 2, structure which appears in FIG. 2 and which has been previously numbered in FIG. 1 bears the same number in FIG. 2. Briefly stated, FIG. 2 includes all of the structure of FIG. 1 except that motor 24 is not shown. In FIG. 2, the upper end of pipe 22 is firmly threadably connected to the lower end of portion 18 and the lower end of pipe 22 is so connected to coupling 28. The structure in FIG. 2 is connected for conventional rotary drilling in which drill string 12 is rotated at the surface in the usual manner.

Turning now to FIGS. 3 and 4, upper assembly 30 of coupling 28 is tubular in shape and includes a set of threads 40 formed in the upper end thereof to enable the coupling to be threadably connected as shown in FIGS. 1 or 2. Lower assembly 32 of the coupling likewise includes a set of threads 42 to enable connection as shown in the preceding figures. Lower assembly 32 has fixedly mounted thereon an upright shaft 44 having an upper end 45 (in FIG. 3), with the shaft having a uniform cross-section as shown in FIG. 4.

Upper assembly 30 and lower assembly 32 are abutted against one another as shown in FIG. 3. A hydraulic seal between the assemblies prevents fluid leakage. The upper and lower assemblies are connected together via a connector (not visible) which permits relative rotation of the assemblies with such rotation being proportional to the amount of torque applied to coupling 28. Such a connection is commercially available and may be formed, e.g., using thrust bearings.

Upper assembly 30 includes a port 46 opposite port 34 as shown in FIG. 4. A valve seat 48 is mounted on the radially inner surface of port 46. A valve stem 50 is adapted for cooperation with valve seat 48 to vary the fluid flowing through port 46 as the stem moves toward and away from the seat. An arm 52 is pivotally mounted on the interior of assembly 30 to permit pivoting about an axis 54. A spring 56 biases valve stem 50, through arm 52, to a predetermined position dependent upon the size of the spring. Port 34 has associated therewith a similar valve seat and stem, arm, and spring.

Consideration will now be given to the operation of the embodiment shown in FIG. 1. Drilling fluid 38 is pumped, from the surface of the well, into drill string 12, through coupling 14, pipe 22 and into motor 24. Such fluid movement into the motor causes rotation of rotor 26, and thus of drill bit 36, in the usual fashion. Fluid continues downwardly through coupling 28 and drill bit 36 and then upwardly into the annulus between the drill string and the wellbore. Some of the fluid is vented into the annulus between coupling 28 and the wellbore via ports 34, 46. As fluid passes through the lower end of drill bit 36, its pressure drops thus reducing the downward force on the bit which is transmitted through coupling 28, motor 24, and pipe 22 to lower tubular portion 18 of coupling 14.

The reduction force is proportional to the surface area of the lower end of the drill bit times the pressure drop of the fluid passing through the bit. This force is sometimes referred to as the "pump-off effect."

Motor 24 may be of the turbine type or of the positive-displacement type. The rotor of a positive-displacement motor rotates at a rate proportional to the fluid flow rate through the motor with increased motor loading requiring an increase in the pressure of fluid passing through the motor to maintain a constant rate of rotor revolution. The power of a positive-displacement motor is proportional to its torque up to the stall point of the motor. The pressure of fluid passing through a turbine-type motor varies relatively little regardless of the load on the turbine. The power produced by a turbine is proportional to its torque times the rate of revolution. Regardless of whether motor 24 in FIG. 1 is a turbine or a positive-displacement motor, variations in the rate of flow through the bit, the characteristics of the drilling fluid, bit wear, and rock characteristics in which the bit is drilling tend to vary the torque applied to the bit. As a result of such variations in conventional drilling operations, the bit may be underutilized thus needlessly lengthening the drilling operation, or on the other hand, may be subject to excessive wear and even catastrophic failure when excessive torque is applied.

The embodiment of the invention in FIG. 1 automatically applies a constant amount of torque to drill bit 36 regardless of variations in fluid flow and characteristics, rock characteristics, and drill bit wear. The torque applied by rotor 26 through coupling 28 to the drill bit is sensed by the coupling in the following manner. As the torque increases, the relative rotational displacement of upper assembly 30 of coupling 28 with respect to lower assembly 32 increases. As the torque increases, lower assembly 32 is angularly displaced in a counter-clockwise direction, in FIG. 4, relative to upper assembly 30. Thus, the ends of shaft 44 act against the pivot arms, like pivot arm 52, causing the valves in ports 34, 36 to move toward their closed position. Such closing decreases the flow of drilling fluid which is vented into the annulus via ports 34, 46 thus forcing more fluid through the lower end of the bit thereby increasing the upward force due to the pumpoff effect. When such force increases, there is less drag between the bit and the rock in which the bit is drilling thus decreasing the bit torque. Thereafter, if the bit passes through relatively harder rock, the torque in coupling 28 decreases thus moving lower assembly 32, and therefore shaft 44, counterclockwise relative to upper assembly 30 thereby opening the valves in ports 34, 46. Such opening increases fluid flow through the ports into the annulus thereby causing less fluid to be pumped through the lower end of drill bit 36 and therefore decreasing the upward force due to the pumpoff effect. When the upward force decreases, additional weight is applied to drill bit 36 which increases the friction between the drill bit and the rock in which it is drilling thereby increasing the torque applied to the drill bit. In the foregoing manner, the torque applied to the drill bit is maintained at a constant predetermined level dependent upon the design characteristics of coupling 28, e.g., the strength of spring 56. The penetration rate of the drill bit is thus optimized regardless of variations in fluid flow and characteristics, drill bit wear, and rock properties. The torque level is selected to be sufficient to utilize the bit but not at a level at which excessive bit wear occurs.

The operation of the embodiment of FIG. 2 is similar to that of FIG. 1. In FIG. 2, a selected revolution rate is applied to drill string 12 while fluid 38 is pumped through the string into coupling 14, pipe 22, coupling 28, and drill bit 36. Some of the fluid is vented to the annulus via ports 34, 46. For a selected revolution rate of drill string 12, the torque applied to the drill bit is maintained at a constant level in the face of changes in rock characteristics, bit wear, drilling fluid flow rate, and drilling fluid characteristics. This is achieved by varying the rate of flow through the lower end of drill bit 36 as a result of variations in flow through ports 34, 46 in coupling 28 as previously described in connection with the operation of the embodiment of FIG. 1.

Figure 5:
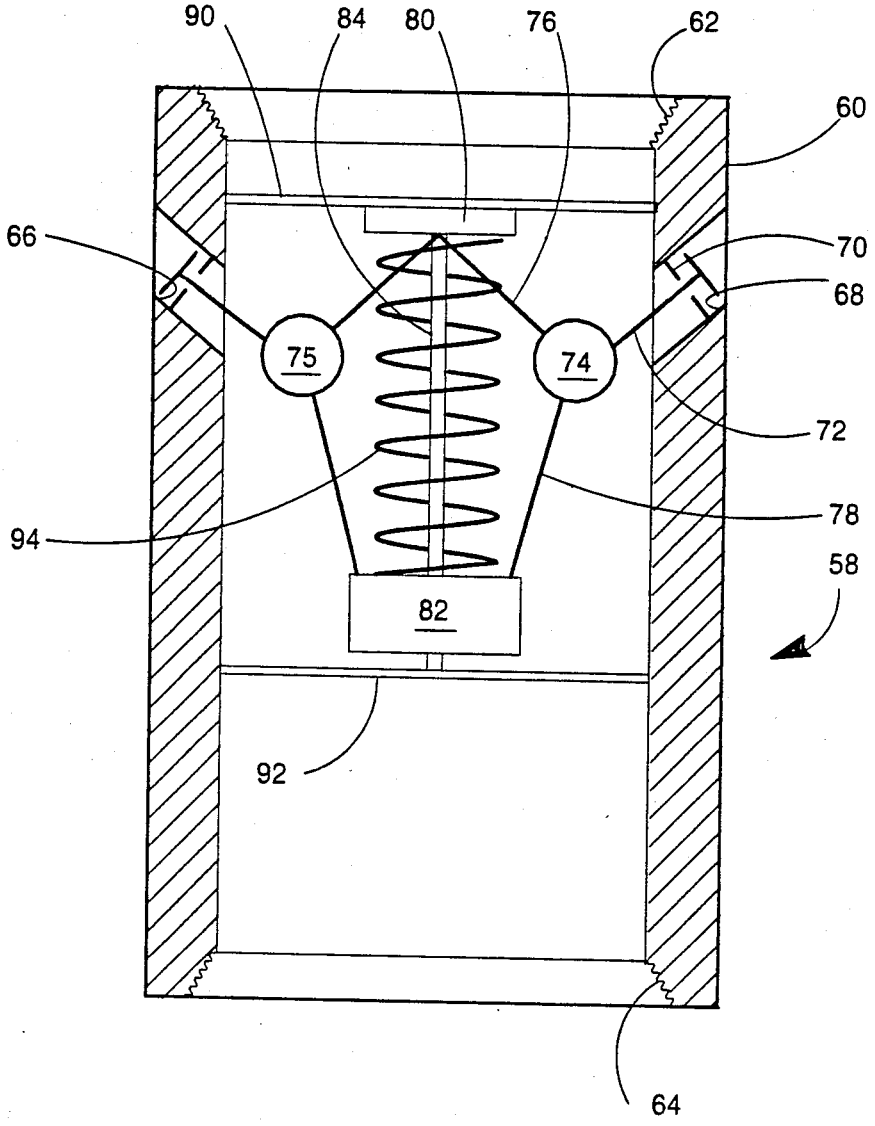
FIG. 5 is a portion of another preferred embodiment of the apparatus of the invention shown partially in cross-section.

Turning now to FIG. 5, indicated generally at 58 is a second embodiment of a coupling, like coupling 28. As will be shortly described, coupling 58 can be used in place of coupling 28 in the configuration of FIG. 1 to control the force applied to drilling. Coupling 58 includes a tubular body 60 having a threaded connection 62 at its upper body end and a threaded connection 64 at its lower end. Body 60 includes a pair of ports 66, 68 which permit fluid communication between the interior and the exterior thereof. A valve seat 70 is fixedly received within port 68 and cooperates with a valve stem 72. Valve stem 72 is operatively connected to a pair of balls 74, 75. Ball 74 has pivotally connected thereto a pair of support members 76, 78. The other end of support member 76 is pivotally connected to an upper turntable 80 while the other end of member 78 is pivotally connected to a lower turntable 82. Each of the turntables is mounted for rotation about the longitudinal axis of a rod 84 which is constrained between upper and lower rod-support structures 90, 92, each of which is fixedly mounted on the radially inner surface of body 60. Rod 84 is received within a spring 94 which is constrained between turntables 80, 82. Balls 74, 75 are operatively connected to valve structure in port 66 similar to that received in port 70. Each of the valve stems serve to vary the amount of fluid which may flow through its associated port. As the stem moves toward its associated valve seat, fluid flow is restricted and as the stem moves away from the valve seat, fluid flow increases.

The operation of the embodiment of the invention employing coupling 58 is similar to the embodiment shown in FIG. 1 except that coupling 28 is replaced by coupling 58. In other words, threaded connection 62 is firmly engaged with the lower end of rotor 26 while drill bit 36 is fixedly threadably engaged with connection 64 on the lower end of coupling 58. Also, motor 24 in the embodiment of the invention utilizing coupling 58 is of the turbine type.

As fluid is pumped into drill string 12, coupling 14, pipe 22, motor 24 and coupling 58, some of the fluid passes through ports 66, 68 into the annulus of the wellbore. Most of the fluid continues downwardly through coupling 58 and out the bottom of drill bit 36. Rotor 26 rotates as a result of fluid passing through motor 24. In a turbine-type motor, the torque is proportional to the rate of revolution of the rotor. As a revolution rate increases, balls 74, 75 spin faster and at a higher vertical elevation due to centrifugal force. As the balls move upwardly, they tend to open the valves in ports 66, 68 thereby increasing fluid flow through the ports to the annulus. When flow through these ports is increased, flow through the bottom of the bit decreases, thereby decreasing the upward force generated by the pumpoff effect. As the rate of revolution of rotor 26 slows, the balls drop in altitude thus closing the valves and permitting decreased fluid flow into the annulus via ports 66, 68 thereby increasing the pump-off effect at the bottom of the bit and decreasing the weight applied to the bit. Thus, coupling 58 serves to maintain the rate of rotation of rotor 26 of the turbine at a constant level by varying the fluid flow, and hence the force generated by the pump-off effect, through the bottom of the drill bit. Since, in a turbine, the rate of revolution is proportional to the torque, the torque applied to drill bit 36 remains at a constant level. Appropriate selection of spring 94, the mass of balls 74, 75, and the size of the openings of the valves in ports 66, 68 predetermines an optimum amount of torque that will be applied to the bit which optimizes the penetration rate without excessively wearing the bit.

Figure 6:
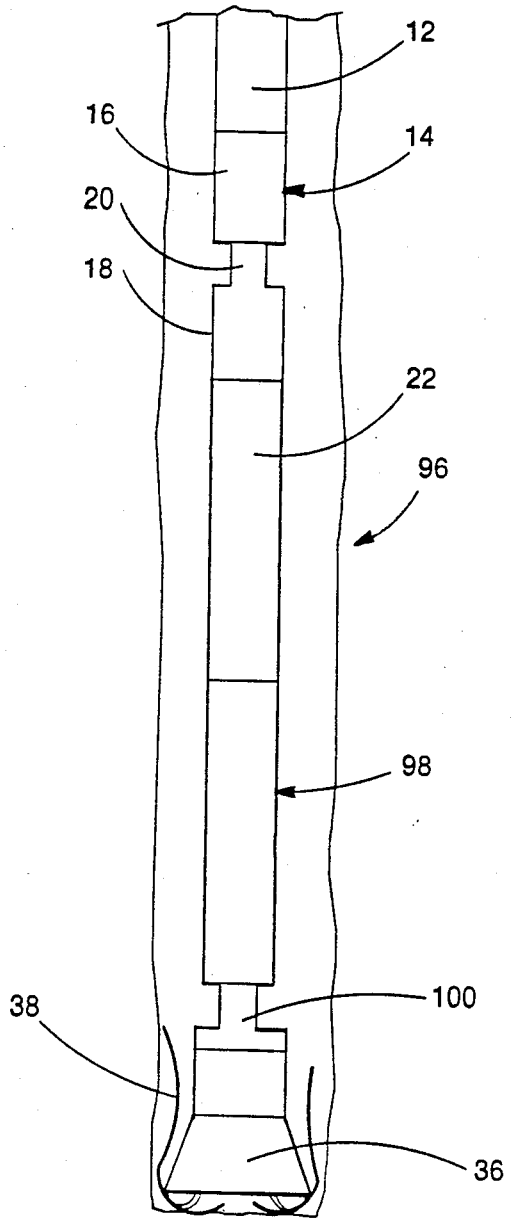
FIG. 6 is a side elevational view of a wellbore having yet another preferred embodiment of the apparatus of the invention therein during drilling operations.

Indicated generally at 96 in FIG. 6 is a wellbore in which another embodiment of the invention is shown in condition for drilling. Structure which has been previously identified in FIG. 1 and which corresponds to similar structure in FIG. 6 has been identified with the same number. FIG. 6 is substantially the same as FIG. 1 except for a turbine 98 which is fixedly connected via a threaded connection (not visible) to the lower end of pipe 22. The turbine includes a rotor 100 extending from the lower end thereof on which drill bit 36 is mounted. Rotor 100 is caused to rotate by fluid pumped into drill string 12 through the components suspended on the lower end of the drill string and into turbine 98. For a more detailed view of turbine 98, attention is directed to FIG. 7.

Turbine 98 includes a tubular housing 102, the upper end of which (not visible in FIG. 7) is firmly threadably connected to the lower end of pipe 22 (in FIG. 6). Rotor 100 extends from the lower end of housing 102. Turbine stator blades 104 are fixedly mounted on the radially inner surface of housing 102. A set of rotor blades 106 are fixedly mounted on the radially outer surface of rotor 100. Indicated generally at 108 is a generator assembly. The generator assembly includes a plurality of conducting coils, two of which are coils 110, 112 which are mounted at spaced intervals on the radially inner surface of housing 102 about its circumference. Also included in generator assembly 108 are a plurality of magnets, like magnets 114, 116, 118 mounted on rotor 100 about its circumference opposite the coils. Generator assembly 108, in the usual manner of a generator, produces a current which is proportional to the rate of rotation of magnets 116 and therefore of rotor 100.

Housing 102 includes a port 120 formed therein. Port 120 permits fluid communication between the interior and exterior of housing 102. A valve assembly, indicated generally at 121, regulates the flow rate of fluid through port 120 by varying the position of a valve stem include din the valve assembly. A valve control, indicated generally at 122, controls operation of the valve assembly. Valve assembly 121 and valve control 122 are shown in more detail in FIG. 8. A set of bearings 124, 126 serve to support rotor 100 and enable rotary movement thereof. A set of threads 128 on the lower end of rotor 100 provides means for threadably connecting drill bit 36 to the rotor.

Figure 7:
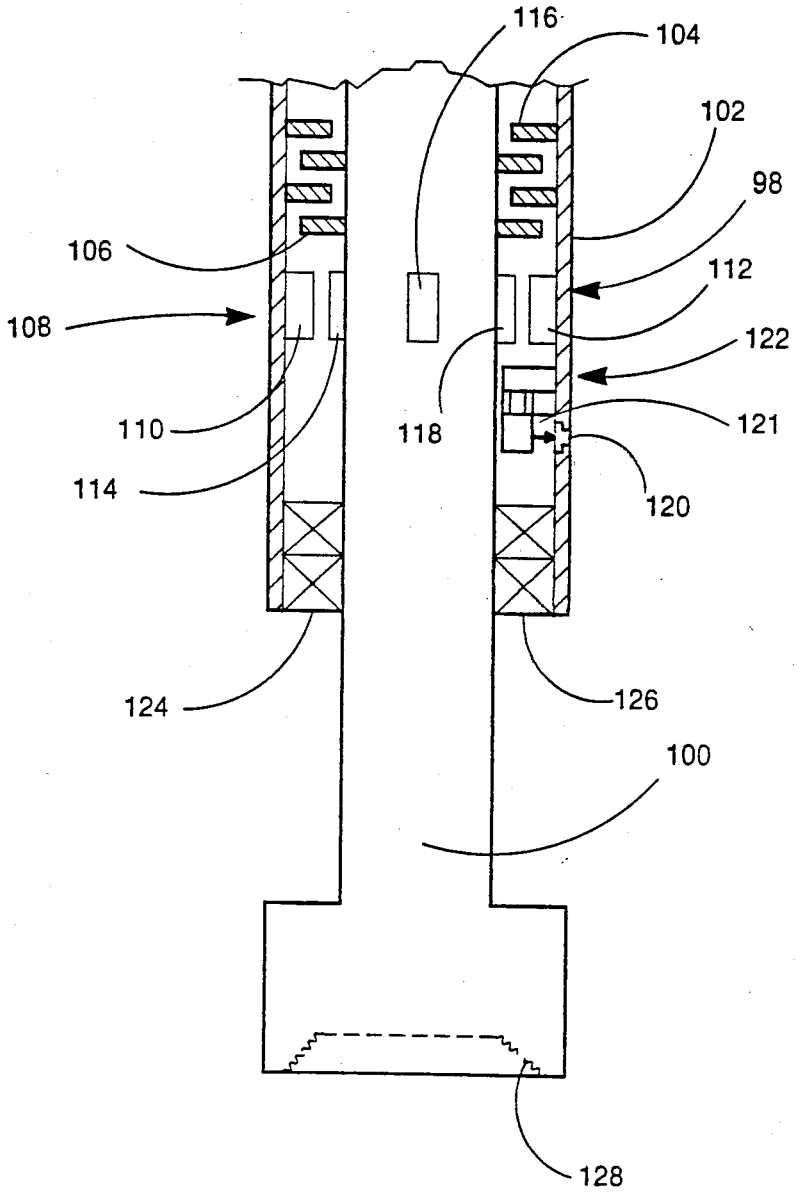
FIG. 7 is an enlarged partially cross-sectional view of a portion of the embodiment shown in FIG. 6.
Figure 8:
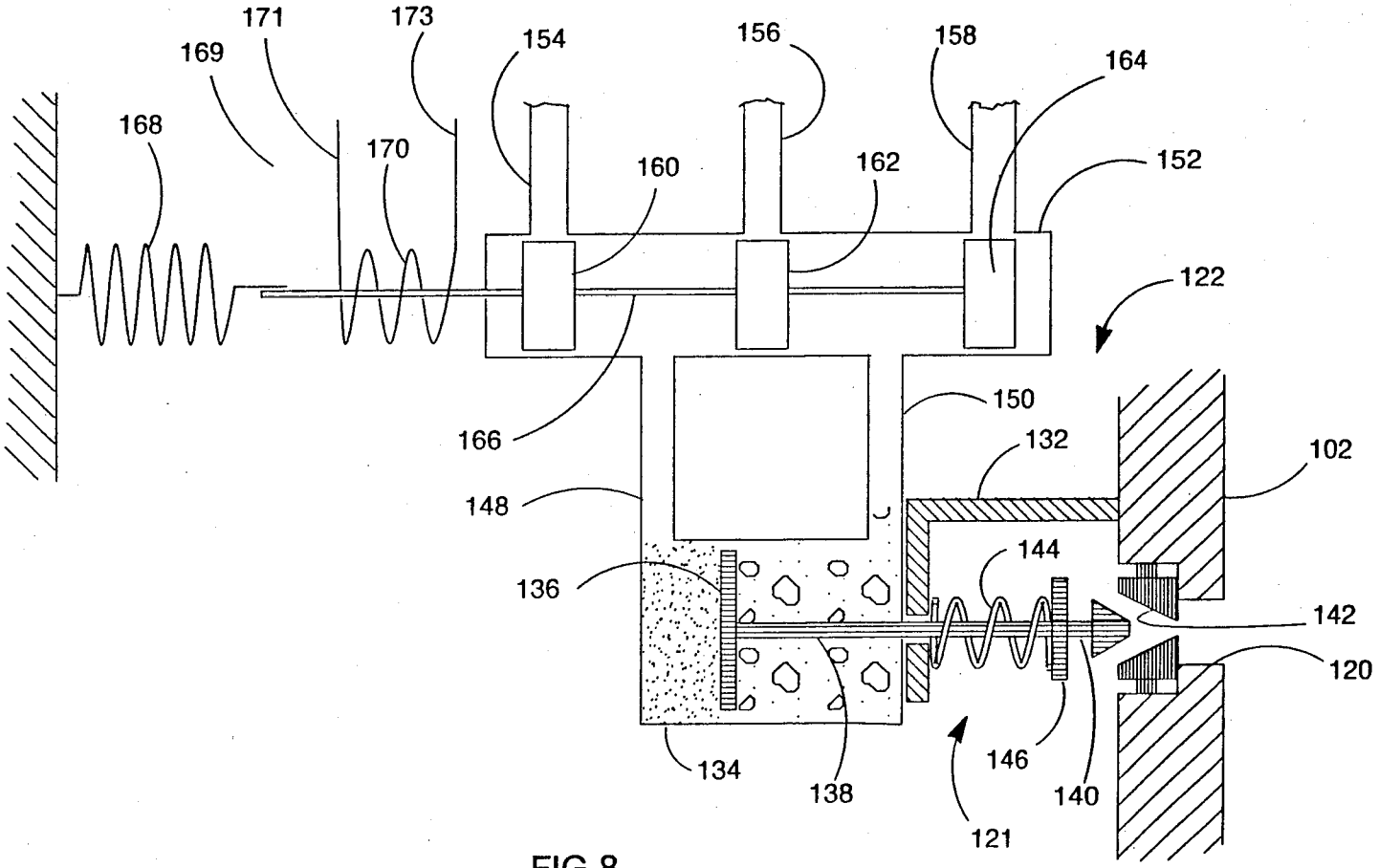
FIG. 8 is an enlarged partially cross-sectional view of a portion of the embodiment shown in FIG. 7.

Attention is directed to FIG. 8 for a more detailed view of the structure which makes up valve assembly 121 and valve control 122. An L-shaped bracket 132 supports a cylinder 134 having a piston 136 slidably received therein. A rod 138 is connected at one end to piston 136 and has formed integrally as a part of its other end a valve stem 140. Stem 140 cooperates in the usual fashion with a valve seat 142 which is mounted on the radially inner surface of housing 102 at port 120. A compression spring 144 is compressed between bracket 132 and a stop 146 fixedly mounted on rod 138. Cylinder 134 is filled with hydraulic fluid and is in fluid communication at one end with a conductor 148 and at the other end with a conductor 150. Each of conductors 148, 150 are in fluid communication with a second cylinder 152. Cylinder 152 is in turn in fluid communication with conductors 154, 156, 158. Conductors 154, 158 are each connected to a tank (not shown) for providing a reservoir into which and from which fluid may be pumped. Conductor 156 is connected to a source (not shown) of pressurized hydraulic fluid. Included in cylinder 152 are three pistons 160, 162, 164. Each of the pistons are slidably received within cylinder 152 and are connected together for ganged operation via a pintel 166. The pintel extends from the left-most end of cylinder 152 and is connected to a spring 168 which biases the pintel into a preselected position. Indicated generally at 169 is means for electrically controlling the lateral position of pintel 166 which may be of the type known as an electromagnetic force actuator. Included therein is a currentconducting coil 170 which is connected via conductors 171, 173 to generator assembly 108 (in FIG. 7). The lateral position of pintel 166 is varied proportional to the current in coil 170.

Considering now the operation of the embodiment in FIGS. 6–8, as fluid is pumped through turbine 98, rotor 100, and drill bit 36, the interaction of the fluid with rotor blades 106 and stator blades 104 rotates rotor 100 in the usual fashion. Some of the fluid is vented via port 120 to the wellbore. As the rotor turns, generator assembly 108 generates a current which is proportional to the rate of rotation and which flows through coil 170 via conductors 171, 173. If the rotary speed of the turbine is below the level necessary to maintain equilibrium between the force generated by coil 170 and that generated by spring 168, valve pintel 166 moves to the right thereby exposing the hydraulic supply pressure in conductor 156 to conductor 148 through cylinder 152. When the supply pressure is applied to conductor 148, piston 136 moves to the right thereby tending to reduce the fluid flow through port 120. When the flow through port 120 is reduced, the flow through the drill bit is increased thereby increasing the pump-off effect which decreases the weight applied to the bit and thus the bit torque. This increases turbine rotary speed which in turn increases the current in coil 170 thereby causing pintel 166 to return to the position shown in FIG. 8. If the rotary speed of the turbine is too high, the current in coil 170 increases and pintel 166 moves to the left thereby exposing the supply pressure in conductor 156 to conductor 150. The increased pressure in the right portion of cylinder 134 moves piston 136 to the left thereby permitting increased fluid flow from the interior of housing 102 through port 120 into the well annulus. This reduces the flow through the drill bit thereby decreasing the pump-off effect and increasing the torque loading of the drill bit due to the increase in weight applied to the bit. Such increased loading reduces the turbine speed thereby reducing the current in coil 170 and causing the pintel to return to its position of equilibrium in FIG. 8. It is to be appreciated that by varying the size of spring 168, the current required to maintain pintel 166 in its equilibrium position, and thus the speed and torque of turbine 98, may be varied.

It should be noted that electromagnetic force actuator 169 could be used directly on valve stem 140 thus removing the need for the hydraulic components shown in FIG. 8. In other words, valve stem 140 can be received within coil 170 and can thereby have its position relative to valve seat 142 controlled by the current in the coil. This configuration is subject to valve seat wear and dynamic forces on the valve stem which could cause the rotary speed of the turbine to drift from its preselected level. The structure shown in FIG. 8 compensates for seat wear and for dynamic forces on the valve stem and thus provides a more reliable control for maintaining the rotation of the rotor at a preselected rate.

Figure 9:
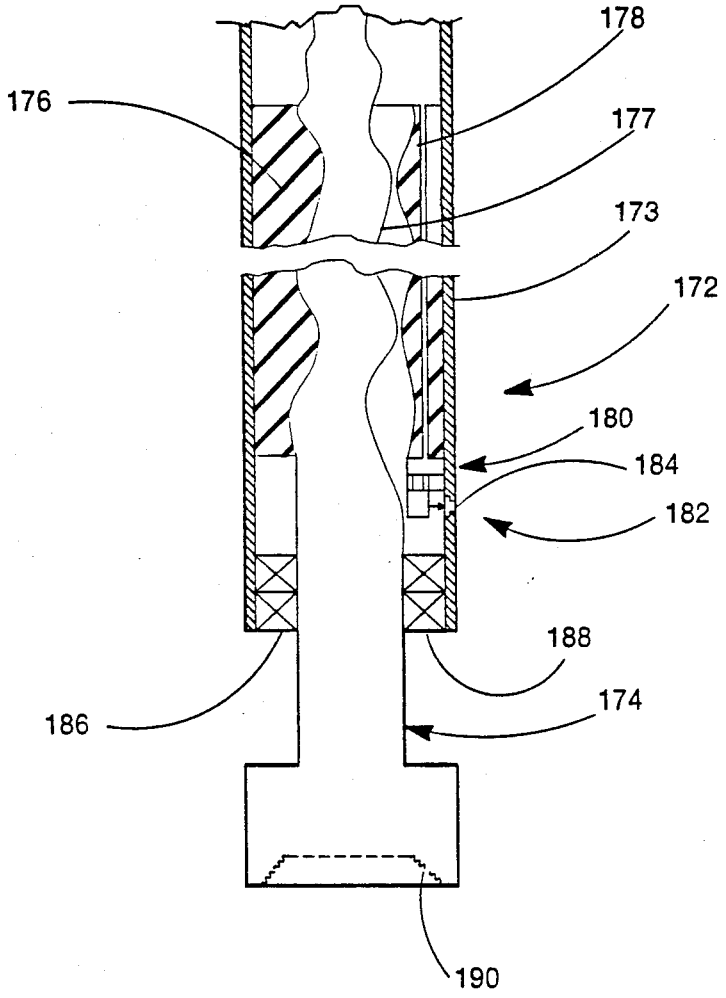
FIG. 9 is a portion of still another preferred embodiment of the apparatus of the invention shown partially in cross-section.

Turning to FIG. 9, indicated generally at 172 is a positive-displacement motor constructed in accordance with a preferred embodiment of the apparatus of the instant invention. Motor 172 may be used in the place of turbine 98 in the configuration shown in FIG. 6. In other words, the upper end of motor 172 (not shown) is threadably connected to the lower end of pipe 22 and drill bit 36 is threadably connected to the lower end of a rotor 174 which forms the lowermost portion of the motor. Included in motor 172 is a tubular housing 173. Motor 172 includes a stator 176 mounted on the interior of housing 173. The stator cooperates with a curved portion 177 of rotor 174 to cause rotation of the rotor as fluid flows through motor 172. A conductor 178 is formed through stator 176 and has its upper end exposed to the fluidic pressure at the upper end of motor 172. The lower end of conductor 178 is connected to a valve control, indicated generally at 180, which in turn is connected to a valve assembly 182. Valve assembly 182 controls the flow rate of fluid between the interior of housing 173 and the annulus of the wellbore through a port 184. Valve control 180, valve assembly 182, and port 184 are shown in greater detail in FIG. 10. Bearings 186, 188 support rotor 174 and enable smooth rotation thereof. A set of threads 190 is formed in the lower end of rotor 174 and provides a means for connecting a drill bit, like drill bit 36, to the lower end of the rotor.

Figure 10:
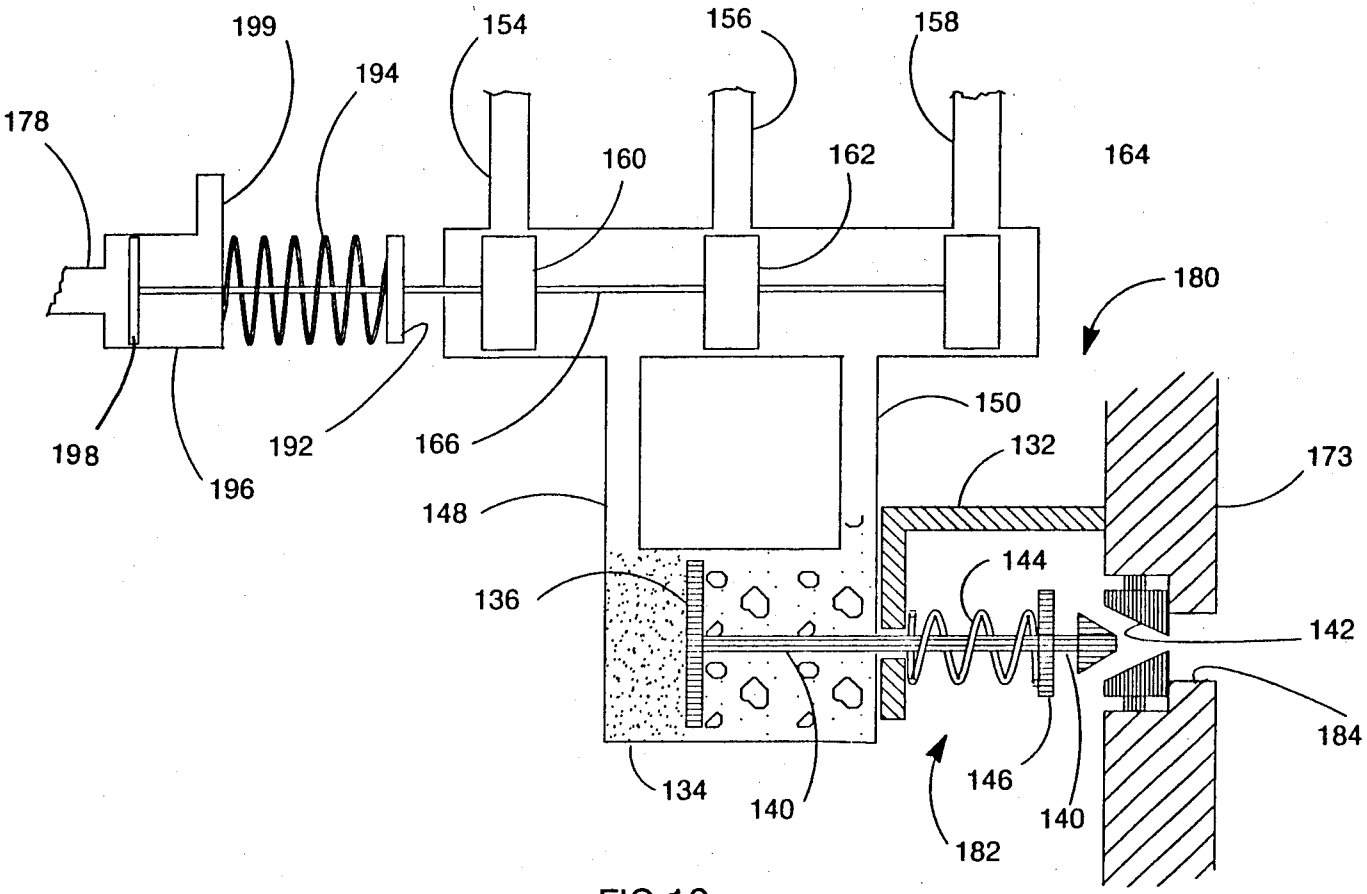
FIG. 10 is an enlarged partially cross-sectional view of a portion of the embodiment shown in FIG. 9.

Turning now to FIG. 10, structure which is similar to that previously identified in FIG. 8 has been identified in FIG. 10 with the same number. The left end of pintel 166 includes a stop 192 fixedly mounted on the pintel. A spring 194 is constrained on pintel 166 between stop 192 and one end of a cylinder 196. The pintel extends into the cylinder and has mounted on its left-most end a piston 198. The left end of cylinder 196 is connected to the lower end of conductor 178 while the other end of cylinder 196 is connected to conductor 199 which is exposed to the fluidic pressure in housing 173 beneath stator 176. Thus, the pressure drop across motor 174 is applied across cylinder 196.

In operation of the embodiment shown in FIGS. 9 and 10, fluid flows through motor 172 thereby rotating rotor 174. The pressure at the top of the motor is applied via conductor 178 to the left side of cylinder 196 while the pressure at the lower end of the motor is applied via conductor 199 to the right side of the cylinder. In a positive-displacement motor, the pressure drop across the motor is proportional to the rotor torque, which is nearly the same as and varies in direct proportion to the torque in the bit. Accordingly, the position of piston 198 in cylinder 196 is indicative of the torque generated by the motor.

When the torque is at the appropriate preselected level which maximizes the drilling penetration rate without damaging the bit, the control assumes the configuration shown in FIG. 10. If the torque rises above the desired level, piston 198 moves pintel 166 to the right thereby exposing the supply pressure in conductor 156 to conductor 148 which in turn moves piston 136 to the right thereby decreasing the amount of fluid flowing through port 184. Thus, the fluid flowing through the drill bit increases thereby increasing the upward force on the drill bit which in turn reduces the weight applied to the bit and decreases bit torque. When the bit torque decreases, the pressure drop across the motor decreases and piston 198 reassumes the position shown in FIG. 10. If the torque should drop below the desired level, the pintel moves to the left thereby exposing supply pressure in conductor 156 to conductor 150. When the right side of cylinder 134 is exposed to the supply pressure, piston 136 moves to the left thereby increasing the flow through port 184 and decreasing the flow through the drill bit which increases the weight applied to the bit. When the bit weight increases, torque increases thus increasing the pressure drop across motor 172 thereby moving piston 198 to the position shown in FIG. 10. It is to be appreciated that conductors 148, 150 in FIG. 10 might be used directly to sense the pressure drop across the motor. In other words, with conductor 148 exposed to the fluid pressure at the top of the motor and conductor 150 exposed to the fluid pressure at the bottom, piston 136 moves to increase and decrease the flow through port 184 in response to pressure changes across the motor as previously described. However, the arrangement of FIG. 10 compensates for valve seat wear and other dynamic forces that might act on the valve in port 184 during operation. Such wear and forces, if uncompensated, would cause the preselected torque level to drift.

The previously-described embodiments all act to maintain a preselected amount of torque in the drill bit by varying the weight applied thereto. Commercially available sensors which sense the strain, and thus the weight, in the drill bit can be used to provide a signal indicative of the applied weight. A commercially available current generator may receive such signals and generate a current proportional thereto. The current generator may be connected to an electromagnetic force actuator, like actuator 169 in FIG. 8, which has associated therewith a valve assembly and valve control like that shown in FIG. 8. In this fashion, fluid flowing through the lower end of the drill bit may be varied to achieve a constant weight applied to the bit as opposed to a constant bit torque.

Consideration will now be given to the manner in which the supply pressure is applied to conductor 156 of the embodiment in FIGS. 8 and 10 and in which tank pressure is provided through conductors 154, 158 in those same embodiments. First, since there is a large pressure difference between the interior of the drill string and the annulus, conductor 156 may be connected to the interior of the drill string and conductors 154, 158 to the annulus thereby providing the necessary high and low fluid pressure sources. However, it may be that the drilling fluid is not sufficiently clean to operate the hydraulic components shown in FIGS. 8 and 10 and that a clean source of high pressure and low pressure hydraulic fluid is required.

Figure 11:
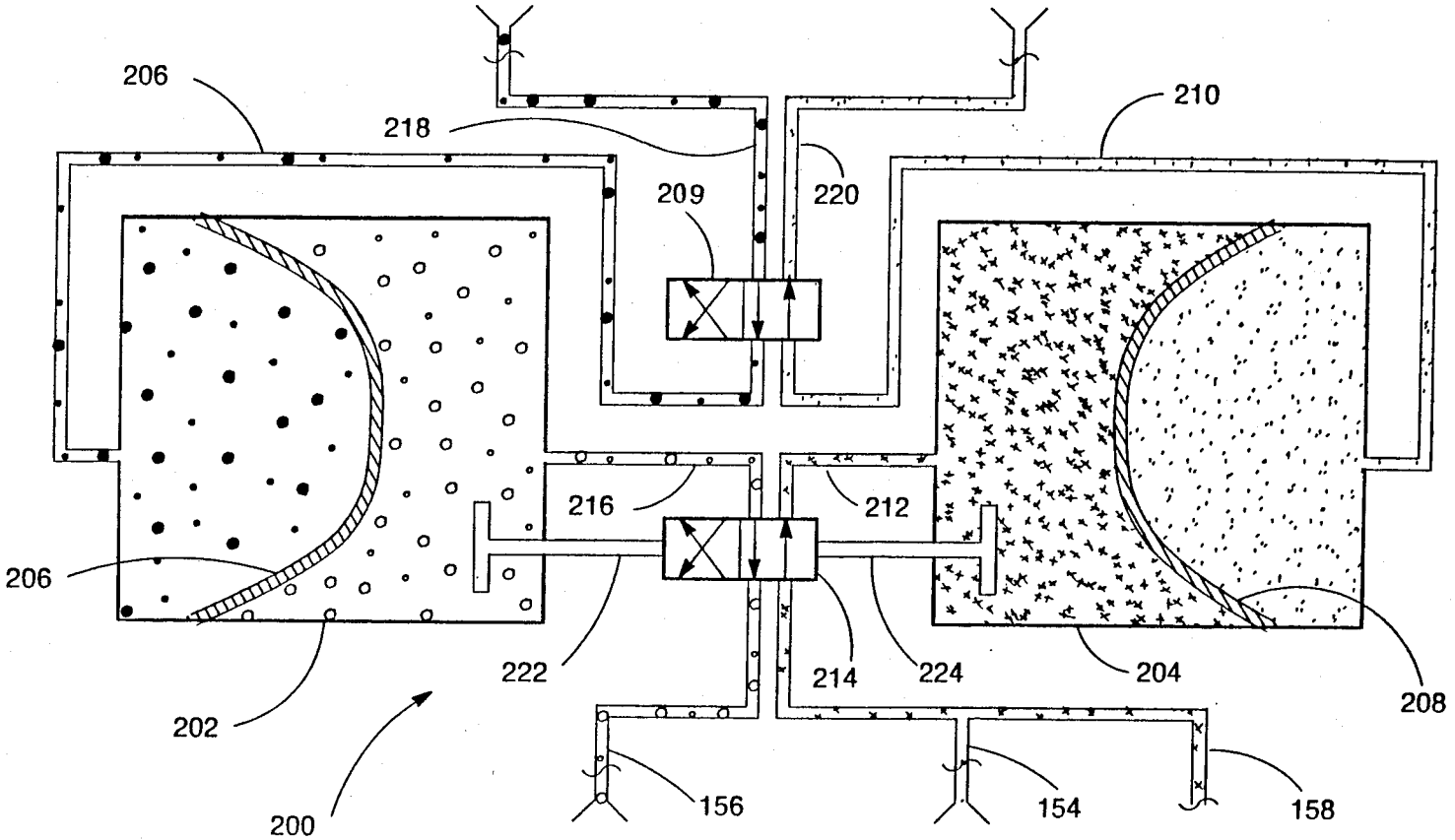
FIG. 11 is a semi-diagrammatic view of a downhole hydraulic power source.

A device for providing such a source is indicated generally at 200 in FIG. 11. Included therein is a pair of tanks 202, 204, each of which includes a bladder 206, 208, respectively, which is stretched across its associated tank and which divides it into two fluidtight portions. Tank 202 is connected via a conductor 206 to a four-way valve 209. Valve 209 is also connected to tank 204 via conductor 210. The other side of tank 204 is connected via a conductor 212 to a second four-way valve 214. Valve 214 is connected to conductors 154, 156, 158 (in FIGS. 8 and 10) as shown. Valve 214 is also connected via a conductor 216 to tank 202. Finally, valve 209 is connected via a conductor 218 to the interior of drill string 12 and by conductor 220 to the annulus between the drill string and the wellbore.

Valve 214 includes a first mechanical valve actuator 222 which extends into tank 202 and a second mechanical valve actuator 224 which extends into tank 204. Valves 209, 214 are mechanically linked together for ganged operation. Therefore, rightward pressure applied to actuator 222 shifts both valves to their other condition. Thereafter, leftward pressure applied to actuator 224 shifts the valves back to the configuration of FIG. 11. Fluid to the right of bladder 206 in tank 202 and to the left of bladder 208 in tank 204 and in conductors 212, 216, 154, 156, 158 is clean hydraulic fluid. Fluid to the left bladder 206 and to the right of bladder 208 and in conductors 206, 210, 218, 220 is drilling fluid.

In operation, with the valves in the configuration shown in FIG. 11, high pressure drilling fluid appears to the left of bladder 206 in tank 202 and low pressure drilling fluid appears to the right of bladder 208 in tank 204. The hydraulic fluid in tank 202, to the right of bladder 206, is pressurized by the drilling fluid in tank 202 thereby supplying high pressure fluid to conductor 156 via conductor 216 and valve 214. As fluid flows from tank 202 via conductor 216, bladder 206 moves to the right and ultimately pushes valve actuator 222 to the right and ultimately pushes valve actuator 222 to the right thereby shifting valves 209, 214 to their other condition. The action of the tank is now reversed with high pressure drilling fluid being applied to tank 204 via conductors 218, 210 and the left side of tank 202 being exposed to low pressure drilling fluid in the annulus via conductor 206, 220. High pressure hydraulic fluid is provided from the left side of tank 204 via conductor 212 and valve 214 to conductor 156. This action continues until bladder 208 contacts valve actuator 224 and urges both valves leftwardly back to the configuration shown in FIG. 11 where the action repeats indefinitely as described.

Thus, the present invention is well adapted to obtain the advantages mentioned, as well as those inherent therein. It is to be appreciated that revisions or modifications may be made to the methods and apparatus disclosed herein without departing from the spirit of the invention which is defined in the following claims.

What is claimed is:

1. An assembly connected within a drillstring below a dowhole turbine or motor and above a drill bit for controllng the quantity of fluid passing to the drill bit, comprising:

a housing having a fluid passageway extending therethrough for permitting fluid passage from the downhole turbine or motor to the drill bit;

sensing means mounted within the housing for sensing a parameter associated with the torque applied to the drill bit;

valve means mounted within the housing; and means acting between the sensing means and the valve means for regulating the quantity of fluid passing to the drill bit in response to the operation of the sensing means by venting a portion of the fluid to the exterior of the housing through the valve means.

2. The assembly of claim 1, the assembly further comprising an upper assembly and a lower assembly mounted to a lower end of the upper assembly by a rotational connector, the lower assembly including a shaft extending therefrom into an interior cavity of the upper assembly, and the valve means being mounted within the upper assembly in operative contact with the shaft for regulating the quantity of fluid passing to the drill bit by venting a portion of the fluid through at least one port in the upper assembly to the exterior of the housing.

3. The assembly of claim 1 wherein the sensing means comprises a swinging mass assembly mounted for rotational operation within the housing and in operative contact with the valving, whereby as the mass moves in response to an increase in the rotational speed of the assembly, the valve means permit a greater quantity of fluid to be vented to the exterior of the housing.

4. A downhole turbine or motor comprising:

a housing including rotor means for rotating an extension in response to the flow of fluid through the housing, a lower end of the extension adapted for connection to a drill bit and the housing adapted for passing fluid to the drill bit;

a generator assembly means mounted within the housing for generating an electrical signal indicative of the rotational speed of the drill bit;

valve means mounted within the housing; and means for passing the electrical signal from the generator assembly to a valve means for regulating the quantity of fluid passing the drill bit in response to the electrical signal by venting a portion of the fluid to the exterior of the housing through the valve means after the fluid has passed through the rotor means.

5. An apparatus for controlling in a wellbore the force applied to a rotating drill bit connected to a lower end of a drillstring and which is adapted to permit fluid circulation through an opening in a lower end thereof, comprising:

means for sensing the rotation rate of the drillbit, the sensing means comprises a flywheel of the type having a rotating mass which changes position in response to the rate of rotation;

valve means mounted within the housing;

means acting between the sensing means and the valve means being operable to vary the flow of fluid through the lower end of the drill bit by venting fluid to the wellbore in response to variations in drill bit rotation through the valve means; and means for permitting axial movement of the drill bit.

6. An apparatus for controlling in a wellbore the force applied to a rotating drill bit connected to a lower end of a drillstring, the lower end including an opening which is adapted to permit fluid circulation therethrough, comprising:

a stationary member;

means for sensing the rotation rate of the drill bit, the sensing means comprising a generator assembly adapted to be disposed between the stationary member and the drill bit to generate an electrical signal indicative of the rotation rate of the drill bit;

valve means mounted within the housing;

means for passing the electrical signal from the generator assembly to a valve means being operable to vary the flow of fluid through the lower end of the drill bit by venting fluid to the wellbore in response to variations in drill bit rotation through the valve means; and means for permitting axial movement of the drill bit.

7. The apparatus of claim 6 wherein the apparatus is adapted to be mounted on the lower end of a hydraulic motor of the type having a rotor and a stator and wherein the generator assembly is disposed between the rotor and the stator.

8. The apparatus of claim 6 wherein the valve is of the type which is controllable by an electrical signal.

* * * * *